US006023025A

United States Patent [19]

Nakahigashi et al.

[11] Patent Number: 6,023,025

[45] Date of Patent: Feb. 8, 2000

[54] ELECTRIC WIRE AND MANUFACTURING METHOD THEREOF

[75] Inventors: Takahiro Nakahigashi; Akira Doi, both of Kyoto, Japan

[73] Assignee: Nissin Electric Co., Ltd., Kyoto, Japan

[21] Appl. No.: 08/859,362

[22] Filed: May 20, 1997

[30] Foreign Application Priority Data

May 24, 1996 [JP] Japan ..... 8-130197

[51] Int. Cl.[7] ..... H01B 7/00

[52] U.S. Cl. ..... 174/110 R; 174/119 R; 174/119 C; 174/120 C; 174/120 FD

[58] Field of Search ..... 174/120 C, 120 AR, 174/120 SR, 110 A, 110 AR, 110 SR; 156/51

[56] References Cited

U.S. PATENT DOCUMENTS 5,274,712 12/1993 Lindsay et al. ..... 381/77
5,303,100 4/1994 Nakayama et al. ..... 3600/104
5,456,980 10/1995 Murakami et al. ..... 428/336
5,611,862 3/1997 Lee et al. ..... 118/723 E
5,677,051 10/1997 Ueda et al. ..... 428/336
5,695,565 12/1997 Lee et al. ..... 118/723 E

FOREIGN PATENT DOCUMENTS 61-166973 7/1986 Japan .
2-100969 4/1990 Japan .

*Primary Examiner*—Kristine Kincaid
*Assistant Examiner*—William H Mayo, III
*Attorney, Agent, or Firm*—Finnegan, Henderson, Farabow, Garrett & Dunner, L.L.P.

[57] ABSTRACT

An electric wire in which a carbon film having abrasion resistance and lubricity is formed on the outer surface of an insulation cover made from at least one kind of material selected from rubber and resin, and covering an electric wire body, and a manufacturing method of the electric wire.

12 Claims, 2 Drawing Sheets

ELECTRIC WIRE AND MANUFACTURING METHOD THEREOF

BACKGROUND OF THE INVENTION

1. Field of the Invention

The present invention relates to an electric wire such as an electric wire used for power transmission and distribution, an electric wire for control, etc., and particularly to an electric wire in which an electric wire body is covered with an insulation cover and a manufacturing method thereof.

2. Description of the Related Art

In an electric wire used for power transmission and distribution, etc., an electric wire body is usually covered with a cover consisting of an electrically insulation material such as rubber, resin or the like in order to keep electrical insulation from articles contacting with the electric wire.

In an electric wire covered with an electrically insulation cover consisting of a material such as rubber, resin or the like, however, the surface of the cover is apt to wear out because of the friction with a frame, a protective tube and the like in an equipment. In addition, because the lubricity of the covered surface is not sufficient, it is difficult to move the electric wire covered with the cover while being in contact with these articles at the time of working such as wiring or the like.

SUMMARY OF THE INVENTION

It is an object of the present invention to provide an electric wire which is hardly worn out by the friction with other articles, and which is superior in the lubricity of its surface, and to provide a manufacturing method thereof.

An electric wire according to the present invention comprises an electric wire body, an insulation cover for covering the electric wire, and a carbon film having abrasion resistance and lubricity formed on an outer surface of the insulation cover.

According to the present invention, it is possible to provide an electric wire which is hardly worn out by friction with any other articles and superior in surface lubricity.

DETAILED DESCRIPTION OF THE INVENTION

Figure 1:
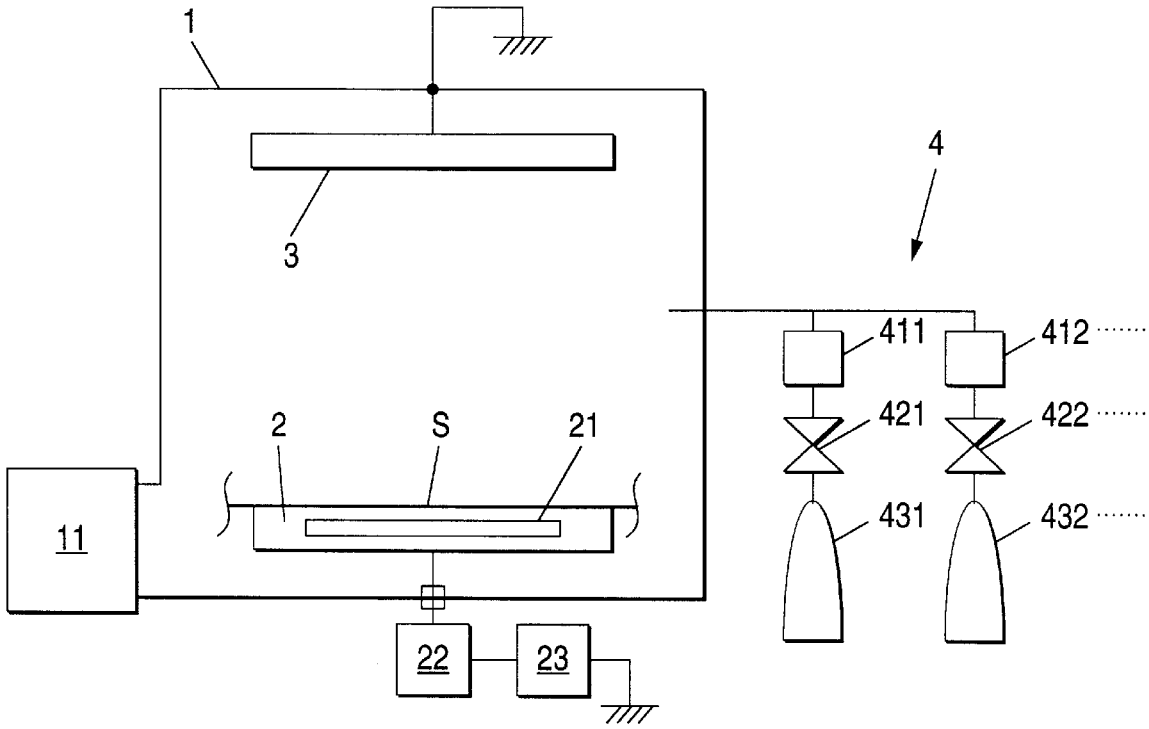
FIG. 1 is a diagram illustrating a schematic structure of an example of a film-forming apparatus which can be used for manufacturing electric wires according to the present invention.

Detailed description of the present invention will be described as follows.

The present invention provides an electric wire in which a carbon film having abrasion resistance and lubricity is formed on an outer surface of an insulation cover covering an electric wire body. In addition, the present invention provides a manufacturing method of an electric wire including a step of forming a carbon film having abrasion resistance and lubricity on an outer surface of an insulation cover covering an electric wire body.

Because a carbon film having abrasion resistance and lubricity is formed on the outer surface of an insulation cover covering an electric wire body, the electric wire according to the present invention is hardly worn out by the friction with other articles, and can slide smoothly on these articles at the time of working such as wiring or the like. Accordingly, the working can be performed easily.

The material of the insulation cover of the electric wire according to the present invention may be the same as that which is usually used for an insulation cover of an electric wire used for power transmission and distribution or an electric wire for control, and one, two or more kinds of rubber, resin and the like may be used as the material of the cover.

Examples of the rubber may include natural rubber, butyl rubber, ethylene-propylene rubber, chloroprene rubber, chlorinated polyethylene rubber, epichlorohydrin rubber, acrylic rubber, nitrile rubber, urethane rubber, silicon rubber, fluoro rubber, etc.

Examples of the resin, as thermosetting resin, may include phenol-formaldehyde resin, urea resin, melamine-formaldehyde resin, epoxy resin, furan resin, xylene resin, unsaturated polyester resin, silicon resin, diallyl phthalate resin, etc.

In addition, example of the resin, as thermoplastic resin, may include vinyl resin such as polyvinyl chloride, polyvinyl dichloride, polyvinyl butyrate, polyvinyl alcohol, polyvinyl acetate and polyvinyl formal; polyvinylidene chloride; chlorinated polyether; polyester resin such as polystyrene and styrene-acrylonitrile copolymer; ABS; polyethylene; polypropylene; polyacetal; acrylic resin such as poly methyl methacrylate and modified acryl; polyamide resin such as nylon 6, 66, 610, 11, etc.; cellulosic resin such as ethyl cellulose, cellulose acetate, propyl cellulose, cellulose acetate butyrate and cellulose nitrate; polycarbonate; phenoxy resin; fluorocarbon resin such as ethylene chloride trifluoride, ethylene tetrafluoride, ethylene tetrafluoride-propylene hexafluoride and vinylidene fluoride; polyurethane; and the like.

As for the insulation cover of the electric wire in the present invention, not only a cover of a one-layer structure but also a cover of a double-layer structure which is, for example, constituted by a polyethylene layer directly covering an electric wire body of stranded wires consisting of aluminum, copper or the like and a vinyl chloride resin layer covering this polyethylene layer, or cover of a structure of three or more layers may be used. In the case of a cover having a multi-layer structure in the electric wire according to the present invention, a carbon film may be formed not only on outer surface of the outermost layer of the cover but also on the outer surface of an inner layer of the cover. For example, in the case of the cover having the above-mentioned double-layer structure of polyethylene and vinyl chloride resin, a carbon film may be formed also on the surface of the polyethylene layer which is an inner layer, for example, in order to prevent damage due to friction with the outer layer of vinyl chloride resin.

In addition, it is preferable that the carbon film in the present invention may be a DLC (Diamond Like Carbon) film representatively. The DLC film is a carbon film which is superior in lubricity, hardly worn out by friction with other articles, and has suitable hardness so as not to lose the original flexibility of the insulation cover coated with this carbon film by adjusting the thickness of the DLC film.

Further, the DLC film can be formed easily, for example, at a comparatively low temperature.

In addition, the thickness of the carbon film may be selected within a range in which the carbon film can function as a protective film of the insulation cover sufficiently, does not lose the original flexibility of the insulation cover, and can be formed onto the cover in tight contact. Specifically, the thickness of the carbon film in the present invention is in the range of 0.2 to 10 $\mu$m in view of the limitation of a film forming speed, preferably in the range of 0.5 to 5 $\mu$m.

Further, in the method according to the present invention, it is considered that the insulation cover is exposed to plasma of at least one kind of gas selected from fluorine (F) containing gas, hydrogen ($H_2$) gas and oxygen ($O_2$) gas as pre-treatment before forming the carbon film. In this case, such pre-treatment is applied to the insulation cover in the electric wire according to the present invention.

Examples of the fluorine containing gas may include fluorine ($F_2$) gas, nitrogen trifluoride ($NF_3$) gas, sulfur hexafluoride ($SF_6$) gas, carbon tetrafluoride ($CF_4$) gas, silicon tetrafluoride ($SiF_4$) gas, disilicon hexafluoride ($Si_2F_6$) gas, chlorine trifluoride ($ClF_3$) gas, hydrogen fluoride (HF) gas, etc.

By exposing the insulation cover to plasma of the pre-treatment gas, the substrate surface is cleansed, or the roughness of the substrate surface is improved. These effects contribute to the improvement of adhesion of the carbon film so that it is possible to obtain a carbon film having high adherence.

The covered surface is terminated with fluorine when fluorine containing gas plasma is used, and the covered surface is terminated with hydrogen when hydrogen gas plasma is used. Fluorine-carbon bonding and hydrogen-carbon bonding are so stable that carbon atoms in the film form stable bonding with fluorine atoms or hydrogen atoms in the covered surface by such terminating treatment. As a result, it is possible to improve adhesion between the cover and the carbon film to be formed later. When oxygen gas plasma is used, it is possible to remove dirt such as an organic matter etc., adhering to the covered surface especially effectively, so that it is possible to improve adhesion between the cover and the carbon film to be formed later.

In the present invention, the pre-treatment of the insulation cover by plasma to be carried out before forming the carbon film on the cover may be performed plural times by using the same kind of plasma or different kinds of plasmas. For example, if the cover is exposed to oxygen gas plasma and then exposed to fluorine containing gas plasma or hydrogen gas plasma, and the carbon film is formed thereon, the covered surface is terminated with fluorine or hydrogen after the surface is cleaned out so that the adhesion between the carbon film to be formed later and the surface of the cover is very superior.

In addition, examples of the method of forming the carbon film in the present invention may include a plasma CVD method, a sputtering method, an ion-plating method, etc., as methods in which a film can be formed at a temperature not to give thermal damage to the insulation cover made from comparatively low heat-resistant material such as rubber, resin or the like. Particularly when a plasma CVD method is used, the pre-treatment of the cover with plasma before formation of carbon film and the formation of the carbon film can be performed by the same apparatus.

As plasma production gas when the carbon film is formed by a plasma CVD method, carbohydrate gas such as methane ($CH_4$), ethane ($C_2H_6$), propane ($C_3H_8$), butane ($C_4H_{10}$), acetylene ($C_2H_2$), benzene ($C_6H_6$), etc., generally used for forming a carbon film, and if necessary, a mixture of any of such carbohydrate gas and any carrier gas such hydrogen gas, inactive gas or the like may be used.

The carbon film in the present invention is formed on the outer surface of the insulation cover covering the electric wire body. In this case, the carbon film may be formed all over the outer surface of the cover, or over a part of the outer surface of the cover (particularly over the portion contacting with other articles and sliding thereon) as occasion demands.

Preferred embodiments of the present invention will be described as follows referring to the accompanying drawings.

Figure 3:
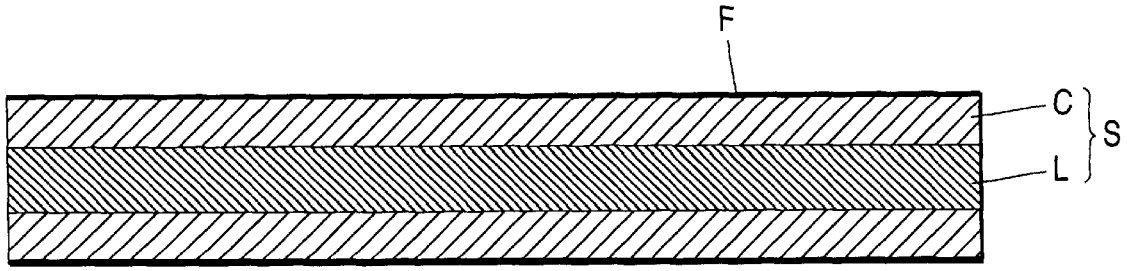
FIG. 3 is a sectional view of an example of an electric wire according to the present invention.

FIG. 1 is a diagram illustrating a schematic structure of a film forming apparatus which can be used for manufacturing an electric wire according to the present invention. In addition, FIG. 3 is a sectional view of an example of the electric wire according to the present invention.

This apparatus has a vacuum chamber 1 provided with an exhaust system 11, and electrodes 2 and 3 are provided in a position opposite to each other in the chamber 1. The electrode 3 is grounded, and a high-frequency power supply 23 is connected to the electrode 2 through a matching box 22. In addition, a heater 21 is provided in the electrode 2 to heat an electric wire S, to which a film is formed and which is contacting onto and supported by the electrode 2, to a film forming temperature. In addition, a gas supply portion 4 is provided in the chamber 1 so that plasma production gas can be introduced into the inside of the chamber 1. The gas supply portion 4 includes one, two or more plasma feed gas sources 431, 432 . . . connected through mass-flow controllers 411, 412 . . . and valves 421, 422 . . . .

In addition, the vacuum chamber 1 has, though not illustrated herein, an electric wire feeding portion for feeding the film-formation electric wires S (to which film is to formed) to the opposite sides of the electrode 2, and an electric wire winding portion for winding the electric wire. The film-formation electric wire S is fed from the feeding portion, and coupled with the winding portion while contacting with the electrode 2 so that the electric wire S can be wound up. In addition, the feeding portion and the winding portion can rotate the electric wire S on the electrode 2 with its length direction as an axis of rotation.

In manufacturing the electric wire according to the present invention by using this apparatus, the film-formation electric wire S in which the electric wire body is covered with an electrically insulation cover in advance is laid between the feeding portion and the winding portion in the vacuum chamber 1 and disposed on the electrode 2, and the inside of the chamber 1 is set into a predetermined degree of vacuum by driving the exhaust system 11. Next, one or more kinds of gases of fluorine containing gas, hydrogen gas and oxygen gas are introduced as pre-treatment gas into the chamber 1 from the gas supply portion 4, while high-frequency power is supplied to the electrode 2 from the high-frequency power supply 23 through the matching box 22, so that the introduced pre-treatment gas is made into plasma, and the surface treatment of the insulation cover of the electric wire S is carried out under the presence of plasma. Although it is preferable to perform this surface treatment (pre-treatment), it is not always necessary to carry out such pre-treatment.

Next, after the chamber 1 is evacuated again as occasion demands, carbon hydride compound gas is introduced as film production gas into the chamber 1 from the gas supply portion 4 and, at the same time, high-frequency power is supplied to the electrode 2 from the high-frequency power supply 23 so as to make the introduced carbon hydride compound gas into plasma, and a carbon film is formed on the outer surface of the insulation cover of the electric wire S under the plasma.

During the surface treatment of the insulation cover and film formation thereon, the electric wire S is moved in the length direction at a constant speed, while the electric wire S is being rotated around the electrode 2 with its length direction as an axis of rotation in the state where the film-formation portion of the electric wire S is brought into contact with the electrode 2, so that surface treatment and film-formation are performed substantially uniformly on the outer circumferential surface of the insulation cover of the electric wire S.

Figure 2:
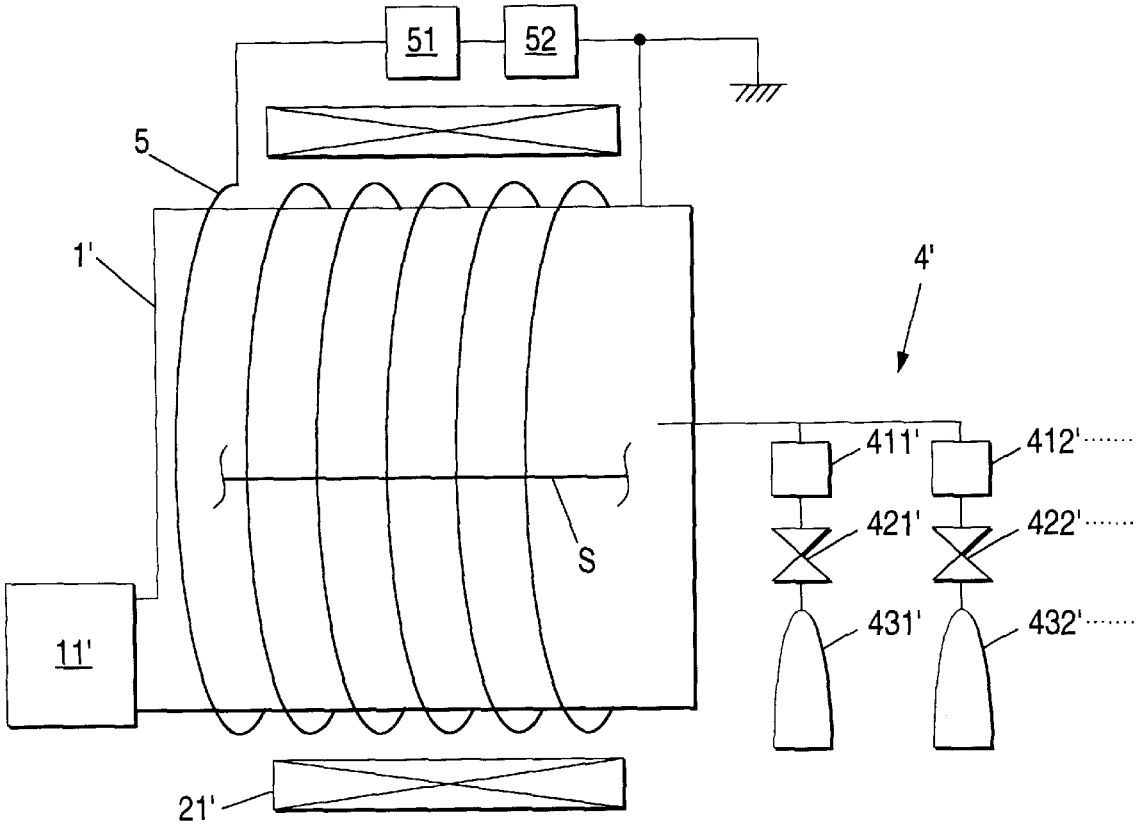
FIG. 2 is a diagram illustrating a schematic structure of another example of a film-forming apparatus which can be used for manufacturing electric wires according to the present invention.

In such a manner, it is possible to obtain a carbon-film-coated electric wire in which an insulation cover C is applied onto the outer circumference surface of an electric wire body L and a carbon film F is formed substantially uniformly on the outer surface of the insulation cover C of the film-formation electric wire S, as shown in FIG. 2.

In addition, when electric wires according to the present invention are mass-produced, a film-forming apparatus as shown in FIG. 2 may be used. This apparatus is an inductive coupled plasma CVD apparatus, in which a vacuum vessel 1' is provided, an induction coil electrode 5 is provided so as to be wound on the outer circumference of the vessel 1', and a matching box 51 and a high-frequency power supply 52 are connected to the opposite ends of the electrode 5 respectively. In addition, a heater 21 for heating a film-formation electric wire S to a film-forming temperature is provided outside the vacuum vessel 1.

In addition, an exhaust system 11' is connected to the vacuum vessel 1' through piping, and a gas supply portion 4' for supplying film production gas is also connected to the vacuum vessel 1' through piping. The gas supply portion 4' includes one, two or more film production gas sources 431', 432' . . . connected through mass-flow controllers 411', 412' . . . and valves 421', 422' . . . , respectively. Although not illustrated herein, a device for feeding and winding the film-formation electric wire are also provided.

Manufacturing of an insulation cover for an electric wire according to the present invention by using this apparatus is performed in the same manner as the surface treatment and carbon-film formation on the insulation cover of the electric wire S by using the apparatus shown in FIG. 1, provided that the raw gas is made into plasma by applying high-frequency power to the induction coil electrode 5. Also in this case, though it is preferable to perform surface treatment (pre-treatment), the pre-treatment is not always necessary.

Next, description will made about examples of the present invention in which, by use of the apparatus of FIG. 1, an DLC film was formed on the outer surface of an insulation cover C of a film-formation electric wire S in which an electric wire body L was coated with the cover C made from polyethylene. Incidentally, in the following Examples, the thickness of the carbon film is set to 5000 Å.

EXAMPLE 1

In the above-mentioned manufacturing of an electric wire by using the apparatus of FIG. 1, an DLC film was formed directly on the outer surface of an insulation cover without performing pre-treatment on the cover with pre-treatment gas plasma.

film-formation cover:

material: polyethylene size outer: diameter 5 mm high-frequency electrode 2:

size: 40 cm×40 cm film-forming conditions:

film-production gas methane: ($CH_4$) 100 sccm high-frequency power: frequency 13.56 MHz, 300 W pressure in film-formation: 0.1 Torr film-forming rate: 500 Å/min electric wire rotating speed: 10 rpm electric wire moving speed: 2 cm/min

EXAMPLE 2

In the above Example 1, pre-treatment with hydrogen gas plasma was applied to the insulation cover before film formation under the following conditions. Film-forming conditions were made to be the same as those in the above Example 1.

Pre-treatment conditions:

pre-treatment gas: hydrogen ($H_2$) 100 sccm high-frequency power: frequency 13.56 MHz, 300 W pressure in treatment: 0.1 Torr electric wire rotating speed: 10 rpm electric wire moving speed: 2 cm/min

EXAMPLE 3

In the above Example 1, pre-treatment with fluorine compound gas plasma was applied to the electric wire body cover before film formation under the following conditions. Film-forming conditions were made to be the same as those in the above Example 1.

Pre-treatment conditions:

pre-treatment gas: sulfur hexafluoride ($SF_6$) 100 sccm high-frequency power: frequency 13.56 MHz, 300 W pressure in treatment: 0.1 Torr electric wire rotating speed: 10 rpm electric wire moving speed: 2 cm/min

EXAMPLE 4

In the above Example 1, first pre-treatment with oxygen gas plasma was applied to the electric wire cover before film formation under the following conditions, and second pre-treatment with hydrogen gas plasma was further applied thereto. Film-forming conditions were made to be the same as those in the above Example 1.

First pre-treatment conditions:

pre-treatment gas: oxygen ($O_2$) 100 sccm high-frequency power: frequency 13.56 MHz, 300 W pressure in treatment: 0.1 Torr electric wire rotating speed: 10 rpm electric wire moving speed: 2 cm/min Second pre-treatment conditions:

pre-treatment gas: hydrogen ($H_2$) 100 sccm high-frequency power: frequency 13.56 MHz, 300 W pressure in treatment: 0.1 Torr electric wire rotating speed: 10 rpm electric wire moving speed: 2 cm/min

EXAMPLE 5

In the above Example 1, first pre-treatment with oxygen gas plasma was applied to the electric wire cover S before film-formation under the following conditions, and second pre-treatment with fluorine compound gas plasma was further applied thereto. Film-forming conditions were made to be the same as those in the above Example 1.

First pre-treatment conditions:

pre-treatment gas: oxygen ($O_2$) 100 sccm high-frequency power: frequency 13.56 MHz, 300 W pressure in treatment: 0.1 Torr electric wire rotating speed: 10 rpm electric wire moving speed: 2 cm/min Second pre-treatment conditions:

pre-treatment gas: sulfur hexafluoride ($SF_6$) 100 sccm high-frequency power: frequency 13.56 MHz, 300 W pressure in treatment: 0.1 Torr electric wire rotating speed: 10 rpm electric wire moving speed: 2 cm/min Next, the insulation covers of the DLC-film-coated electric wires obtained by the aforementioned Examples 1, 2, 3, 4 and 5 according to the present invention, and a insulation cover of a not-treated electric wire in which a DLC film was not formed (comparative example) were evaluated with respect to the frictional coefficient with aluminum material and the abrasiveness with diamond material, and the insulation covers of the respective electric wires obtained by the aforementioned Examples 1, 2, 3, 4 and 5 were evaluated with respect to the adhesion between the DLC films and the covers respectively. The frictional coefficient was evaluated by measuring a value when a pin-like article made of aluminum was moved on the insulation cover at the speed 20 mm/sec with the load of 10 g, and the abrasiveness was evaluated by measuring abraded thickness per unit time when a pin-like article made of diamond was moved on the insulation cover at the speed 20 mm/sec with the load of 200 g. The film adhesion was evaluated by a pulling method in which a circular cylindrical member was bonded to the film surface by use of a bonding agent, the circular cylindrical member was pulled perpendicularly to the film so that the film was separated from the cover body, and a force required for the separation was measured.

The result was shown in the following table.

| Adhesive Strength (kg/mm$^2$) | Frictional Coefficient | Abrasiveness ($\mu$m/h) | Film |
|---|---|---|---|
| Example 1 | 1.5 | 0.9 | 2 |
| Example 2 | 1 | 0.7 | 4 |
| Example 3 | 1 | 0.7 | 4 |
| Example 4 | 1 | 0.5 | 5 |
| Example 5 | 1 | 0.5 | 5 |
| Comparative Example | 3 | 2.3 | — |

As shown in the table, in the DLC-film-coated insulation covers of the respective electric wires of Examples 1 to 5 according to the present invention, the frictional coefficient of the insulation cover against aluminum material was smaller than that of the not-DLC-film-coated insulation cover of the comparative example, and the value of abrasiveness of the insulation material with diamond material was also smaller.

In addition, as for the adhesive strength of the respective DLC films to the cover body in Examples 1 to 5, the value of the adhesive strength in the electric wire insulation covers in Examples 2 to 5 in which pre-treatment with plasma was applied to the covered surface before DLC film formation was larger than that in the electric wire insulation cover in Example 1 in which pre-treatment was not applied.

Incidentally, in the above Examples, the friction coefficient is preferably equal to or less than 1.5 and the friction amount is preferably in the range of 0.5 to 1.0 $\mu$m/h.

It is understood from the above result that an electric wire according to the present invention in which a carbon film (particularly a DLC film) is formed on the outer surface of an insulation cover is superior in lubricity and abrasion resistance. In addition, it is understood that a carbon film formed after pre-treatment is superior in adhesion.

What is claimed is:

1. An electric wire comprising:

an electric wire body;

a flexible insulation cover covering said electric wire; and a carbon film having abrasion resistance and lubricity formed on an outer surface of said insulation cover, said carbon film having a thickness of about 0.2 $\mu$m to 10 $\mu$m to maintain the flexibility of the insulation cover.

2. The electric wire according to claim 1, wherein said insulation cover is exposed to a plasma made of at least a fluorine (F) gas, a hydrogen ($H_2$) gas, or an oxygen ($O_2$) gas.

3. The electric wire according to claim 1, wherein said carbon film is formed by plasma CVD.

4. The electric wire according to claim 1, wherein said carbon film is a DLC film.

5. The electric wire according to claim 1, wherein said insulation cover is made from rubber or resin.

6. A manufacturing method of an electric wire comprising forming a carbon film having abrasion resistance and lubricity on an outer surface of a flexible insulation cover covering an electric wire body, said carbon film having a thickness of about 0.2 $\mu$m to 10 $\mu$m to maintain the flexibility of the insulating cover.

7. The manufacturing method of said electric wire according to claim 6, further comprising, before a forming step, exposing said insulation cover to a plasma made of at least a fluorine (F) gas, a hydrogen ($H_2$) gas, or an oxygen ($O_2$) gas.

8. The manufacturing method of said electric wire according to claim 6, wherein said carbon film is formed by plasma CVD.

9. The manufacturing method of said electric wire according to claim 6, wherein said carbon film is a DLC film.

10. The manufacturing method of said electric wire according to claim 6, wherein said insulation cover is made of rubber or resin.

11. The manufacturing method of said electric wire according to claim 6, further comprising, before a forming step, exposing said insulation cover to a plasma of oxygen ($O_2$) gas; and thereafter, exposing said insulation cover to a plasma made of a fluorine (F) gas, a hydrogen ($H_2$) gas, or an oxygen ($O_2$) gas.

12. An electric wire according to claim 6, wherein said carbon film has a thickness of 0.5 $\mu$m to 5 $\mu$m.

* * * * *